US011957295B2

(12) United States Patent
Hillery

(10) Patent No.: US 11,957,295 B2
(45) Date of Patent: Apr. 16, 2024

(54) PNEUMATIC VACUUM CLEANER

(71) Applicant: Richard Hillery, Tampa, FL (US)

(72) Inventor: Richard Hillery, Tampa, FL (US)

( * ) Notice: Subject to any disclaimer, the term of this patent is extended or adjusted under 35 U.S.C. 154(b) by 53 days.

(21) Appl. No.: 17/540,406

(22) Filed: Dec. 2, 2021

(65) Prior Publication Data

US 2023/0172409 A1 Jun. 8, 2023

(51) Int. Cl.

| | |
|---|---|
| ***A47L 7/06*** | (2006.01) |
| ***A47L 9/14*** | (2006.01) |
| ***A47L 9/22*** | (2006.01) |
| ***A47L 9/28*** | (2006.01) |

(52) U.S. Cl.

CPC ..... *A47L 7/06* (2013.01); *A47L 9/1409* (2013.01); *A47L 9/22* (2013.01); *A47L 9/2884* (2013.01); *A47L 2201/04* (2013.01)

(58) Field of Classification Search

CPC . A47L 7/06; A47L 9/1409; A47L 9/22; A47L 9/2884; A47L 9/08; A47L 2201/04; B08B 5/00; B08B 5/12; B64U 10/13; B64U 2201/10; B64U 2201/20; B64U 2101/29; B64C 39/006; B05B 5/00; B05B 3/023; B05B 3/025; B05B 3/026

USPC ..... 15/345, 346

See application file for complete search history.

(56) References Cited

U.S. PATENT DOCUMENTS

| | | | | |
|---|---|---|---|---|
| 3,694,848 A | | 10/1972 | Alcala | |
| 4,300,261 A | | 11/1981 | Woodward et al. | |
| 5,048,275 A | * | 9/1991 | Fassauer | A01D 34/695 15/345 |
| 5,647,092 A | | 7/1997 | Miwa | |
| 7,059,012 B2 | | 6/2006 | Son et al. | |
| 2003/0192144 A1 | | 10/2003 | Song et al. | |

(Continued)

FOREIGN PATENT DOCUMENTS

| | | | | |
|---|---|---|---|---|
| CN | 112263182 A | * | 1/2021 | A47L 7/00 |
| JP | 2017024399 A | * | 2/2017 | B29C 65/48 |

(Continued)

OTHER PUBLICATIONS

English translation of WO2014171750A1 (Year: 2014).*
English translation of CN112263182A (Year: 2021).*
English translation of JP2017024399A (Year: 2017).*

*Primary Examiner* — Laura C Guidotti
*Assistant Examiner* — Sukwoo James Chang
(74) *Attorney, Agent, or Firm* — ALLEN, DYER, DOPPELT + GILCHRIST, P.A.

(57) ABSTRACT

A pneumatic vacuum, cleaner includes an external body shell having an internal chamber defined therein and a dustbin carried within the internal chamber of the external body shell. The cleaner also includes an impeller housing positioned below the dustbin and having an inlet coupled to the dustbin. In addition, the cleaner includes an impeller within the impeller housing and is configured to pressurize air exiting the impeller housing. A manifold is mounted to the impeller housing and includes a plurality of air nozzles configured to direct air downward and away from the manifold to entrain debris into the air and simultaneously use the pressurized air to lift the cleaner. A concentric passageway is formed adjacent an inside surface of the external body shell and is configured to recirculate the pressurized air from the plurality of air nozzles back to the dustbin and the impeller housing via the concentric passageway.

18 Claims, 3 Drawing Sheets

(56) References Cited

U.S. PATENT DOCUMENTS

| | | | | |
|---|---|---|---|---|
| 2010/0218337 | A1* | 9/2010 | Tan | A47L 5/362<br>15/347 |
| 2012/0260454 | A1 | 10/2012 | Lester | |
| 2018/0127097 | A1* | 5/2018 | Zapata | B63H 11/113 |
| 2020/0000302 | A1* | 1/2020 | Morin | A47L 11/4088 |
| 2020/0214527 | A1* | 7/2020 | Resch | A47L 11/19 |
| 2021/0038032 | A1 | 2/2021 | Brown | |

FOREIGN PATENT DOCUMENTS

| | | | | |
|---|---|---|---|---|
| WO | WO2014171750 | A1 * | 10/2014 | A47L 9/02 |
| WO | WO2014207449 | A2 * | 12/2014 | A47L 9/12 |
| WO | WO2021026438 | | 2/2021 | |

* cited by examiner

PNEUMATIC VACUUM CLEANER

TECHNICAL FIELD

The present invention relates to the field of vacuum cleaners, and, more particularly, to a pneumatic vacuum cleaner.

BACKGROUND

Existing attempts to improve the performance of vacuum cleaners are well known. For example, robot vacuum cleaners can move randomly around a room autonomously without having to manually pushed. The robot vacuum cleaners are typically driven by a pair of wheels that allows it to move any different directions. In addition, the robot vacuum cleaner includes a rotating brush and a motor for generating suction to draw dirt and debris up inside the cleaner as it moves around the room similar to a conventional vacuum cleaner.

However, these existing vacuum cleaners do not thoroughly clean the floors. For example, sand, dust, dust mites or other allergens can be left behind in carpet because the brush and suction force is not sufficient.

Accordingly, what is needed in the art is an improved vacuum cleaner that is efficient and effective in removing contaminants from all types of flooring.

SUMMARY

A pneumatic vacuum cleaner is disclosed. The pneumatic vacuum cleaner includes an external body shell having an internal chamber defined therein and a dustbin carried within the internal chamber of the external body shell and having an upper surface and a lower surface. The cleaner also includes an impeller housing positioned below the dustbin and having an upper surface and a lower surface, where the upper surface has an inlet therein and is coupled to the dustbin. In addition, the cleaner includes an impeller rotationally mounted within the impeller housing and is configured to pressurize air exiting the impeller housing. A manifold is mounted to the lower surface of the impeller housing and has a plurality of apertures formed in an upper surface of the manifold for receiving the pressurized air. The cleaner includes a plurality of air nozzles secured proximate a lower surface of the manifold and configured to direct air downward and away from the manifold to entrain debris into the air and simultaneously use the pressurized air to lift the cleaner. A concentric passageway is formed adjacent an inside surface of the external body shell and is configured to recirculate the pressurized air from the plurality of air nozzles back to the dustbin and the impeller housing via the concentric passageway.

The dustbin may include a removable collector configured to remove debris from the air before it enters the inlet of the impeller housing, and a skirt may be secured to a bottom edge of the external body shell. In a particular aspect, the impeller may be a Tesla impeller or a multi-stage impeller. An electric motor is coupled to the impeller and a rechargeable power source may be used to drive the electric motor. A bottom surface of the manifold may have a layer of ultra-high-density polyurethane to allow sliding over obstacles. In addition, the cleaner may have a propulsion tube and nozzle, where the propulsion tube is coupled to the manifold and is configured to receive pressurized air and direct the pressurized air away from the external body shell to propel the cleaner. The external body shell may have an access plate positioned to access and remove the collector from the dustbin inside the external body shell.

In another particular aspect, a pneumatic vacuum cleaner includes an external body shell having an internal chamber defined therein, an impeller housing within the internal chamber and having an upper surface and a lower surface, an impeller rotationally mounted within the impeller housing and configured to pressurize air exiting the impeller housing, and a manifold mounted to the lower surface of the impeller housing for receiving the pressurized air. The cleaner also includes a plurality of air nozzles secured proximate a lower surface of the manifold and configured to direct air downward and away from the manifold to entrain debris into the air and simultaneously use the pressurized air to lift the cleaner, and a propulsion device coupled to the manifold and configured to receive pressurized air and direct the pressurized air away from the cleaner to propel the cleaner.

In another particular aspect, a pneumatic vacuum cleaner includes an impeller housing having an upper surface and a lower surface, an impeller mounted within the impeller housing and configured to pressurize air exiting the impeller housing, and a manifold mounted to the lower surface of the impeller housing for receiving the pressurized air. The cleaner also includes a plurality of air nozzles secured proximate a lower surface of the manifold and configured to direct air downward and away from the manifold to entrain debris into the air and simultaneously using the pressurized air to lift the cleaner, and a propulsion device. A passageway is configured to return air from the plurality of air nozzles back to the impeller housing.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

The invention of a pneumatic vacuum cleaner as explained below can be manufactured for a relatively low cost and with relatively few parts. The vacuum cleaner can effectively clean a floor unattended and can operate on both hard flooring surfaces such as tile and also soft flooring surfaces such as carpet. The vacuum cleaner does not require any beater brushes or wheels to operate and does not spew dirty air because it is a closed vacuum system.

Figure 1:
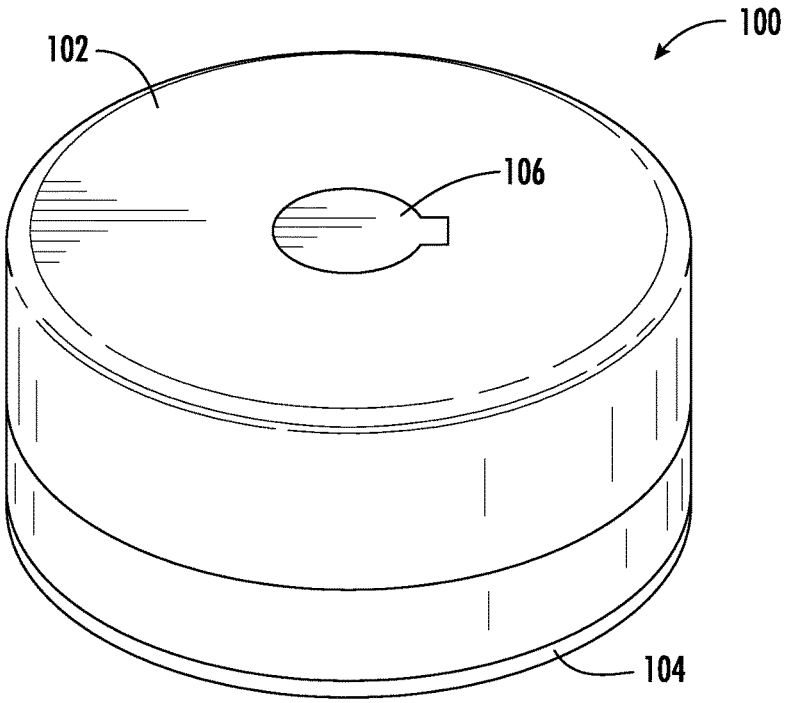
FIG. 1 is a perspective view of a pneumatic vacuum cleaner in which various aspects of the disclosure may be implemented.

Referring now to FIG. 1, the pneumatic vacuum cleaner 100 is illustrated. The cleaner 100 includes an external body shell 102 that may be generally a disc shape. However, the external body shell 102 is not limited to a disc or round shape as those of ordinary skill in the art can appreciate. An access plate 106 is positioned in the center of the external body shell 102 and is used to access a dustbin discussed below.

In a particular aspect, a skirt 104 is secured along a bottom edge of the external body shell 102. The skirt 104 is a flexible material and is configured to prevent pressurized air from escaping out from under the external body shell 102. The skirt 104 is not needed in another aspect when the air traveling through the cleaner 100 is almost all recirculated. The air changes density as it goes through to become high pressure or low pressure. As such, the air between the ground and the bottom of the high-pressure air nozzles (discussed below) will go upwards to be sucked back in and recirculated. There will be some of the air that escapes without the skirt 104, but this is compensated by the vacuum sucking this air back in rapidly.

Figure 2:
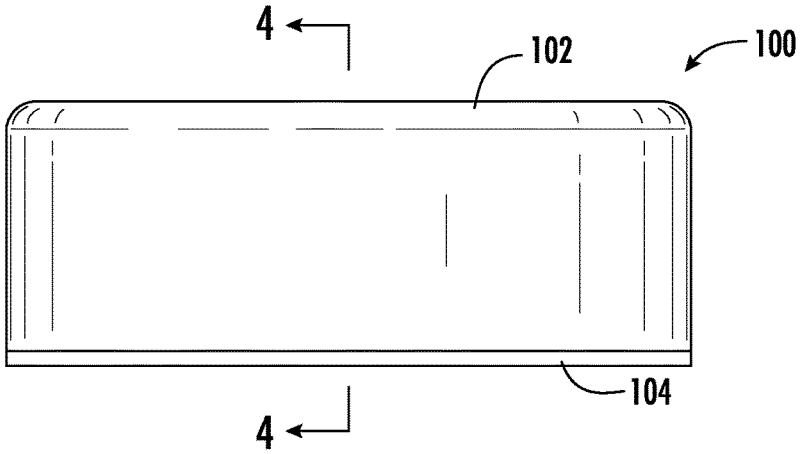
FIG. 2 is an elevational view of the pneumatic vacuum cleaner of FIG. 1.

In particular, the cleaner 100 is configured to operate on a cushion of pressurized air and to "fly" above the flooring surface using a hovercraft technique. Accordingly, when the cleaner 100 is powered on, the pressurized air lifts or raises the external body shell 102 off the flooring and the skirt 104 lowers down to extend between the bottom edge of the external body shell 102 and the flooring making a seal a shown in FIG. 2.

Figure 3:
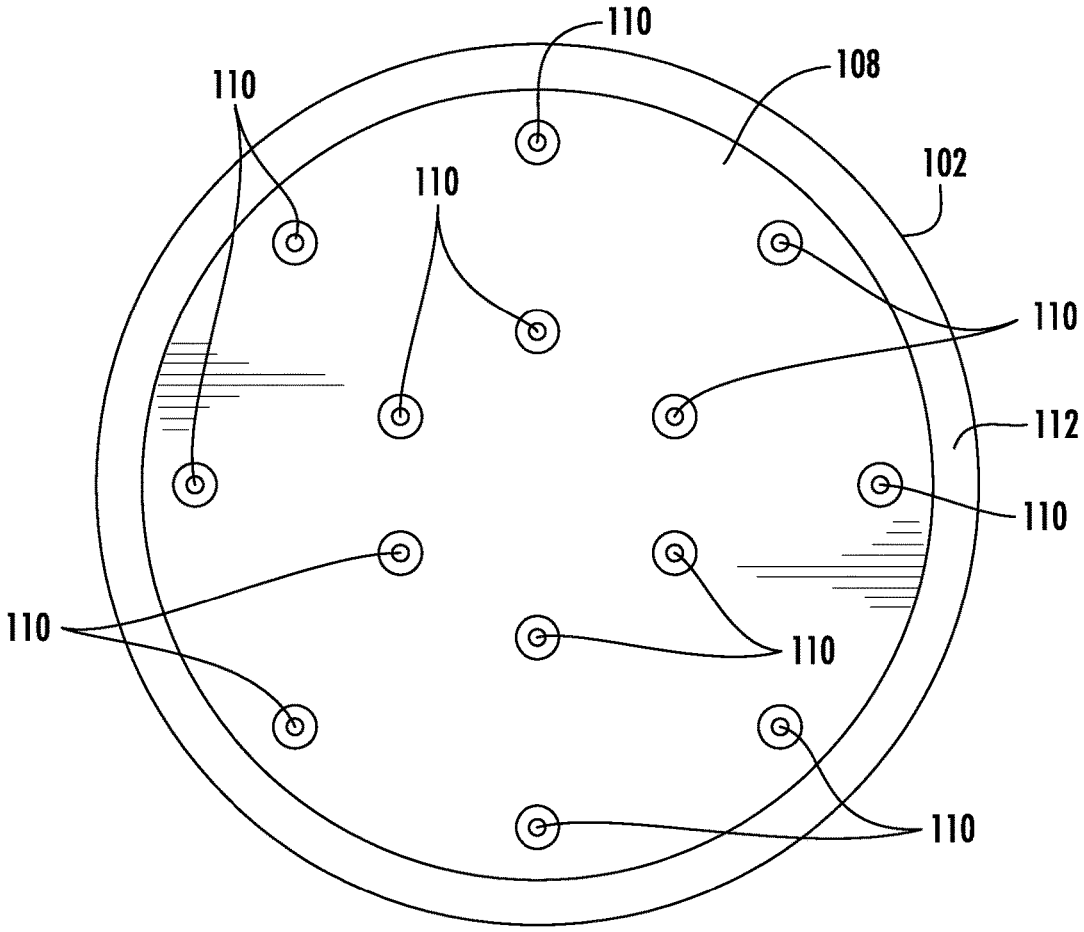
FIG. 3 is a bottom view of the pneumatic vacuum cleaner of FIG. 1.

The pressurized air is dispersed through a plurality of air nozzles 110 that are secured to a bottom of a manifold 108 as best viewed in FIG. 3. The bottom of the manifold 108 may be covered by a low friction layer of material such as ultra high density polyurethane, for example. The air nozzles 110 are positioned to lift the cleaner 100 by directing the air flow downward again the flooring. As explained above, the skirt 104 prevents the air from escaping from under the external body shell 102 in order to provide lift. In addition, the air nozzles 110 agitate the flooring material to entrain debris up and off the flooring and into the airstream. For example, sand that is embedded within carpet can be dislodged by the pressurized air being directed downward into the fibers of the carpet with sufficient force.

Figure 4:
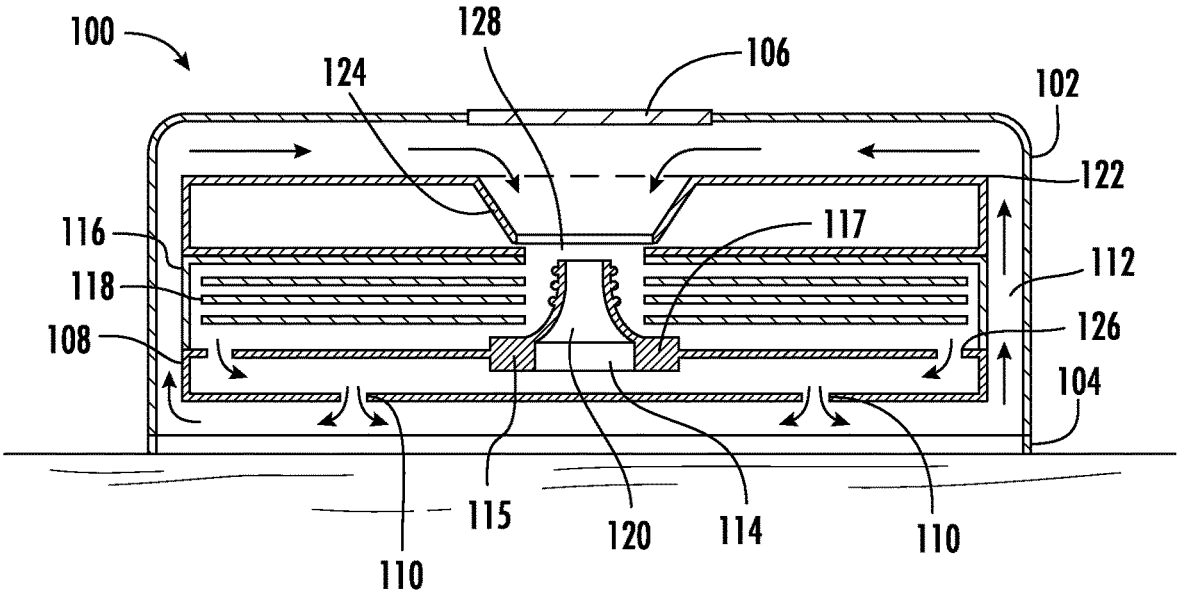
FIG. 4 is a cross sectional view of the pneumatic vacuum cleaner taken in the direction of line 4-4 of FIG. 2.

Referring now to FIG. 4, a cross sectional view of the internal elements of the cleaner 100 is shown along with the pathway of the recirculating airflow through the cleaner 100. The external body shell 102 encloses the moving parts of the cleaner 100 within an internal chamber. A dustbin 122 is carried within the internal chamber of the external body shell 102 and has an upper surface and a lower surface. For orientation, the reference to an upper surface of a particular element of the cleaner 100 is intended to reference a position further away from the flooring and a lower surface is intended to reference a relative position closer to the flooring. The dustbin 122 includes a removable collector 124 that is configured to remove debris from the air before it enters an inlet 128 of the impeller housing 116.

The impeller housing 116 is positioned below the dustbin 122 and has an upper surface and a lower surface, where the upper surface has the inlet 128 and is coupled to the dustbin 122. An impeller 118 is rotationally mounted within the impeller housing 116 and is configured to pressurize air exiting the impeller housing 116. The impeller 118 may be a Tesla impeller, a typical impeller, or a multi-stage impeller, for example.

However, those of ordinary skill in the art can appreciate that different types and configurations of impellers may be used to pressurize the air. For example, the impeller could be a multi-stage by having one stage attached to the motor shaft 120, and the second stage attached to the motor housing, with the housing mounted on bearings. This would not only allow the two stage compression, but the alternating direction and freely rotating platters will prevent torque spinning the vacuum cleaner 100 while it is airborne.

Figure 5:
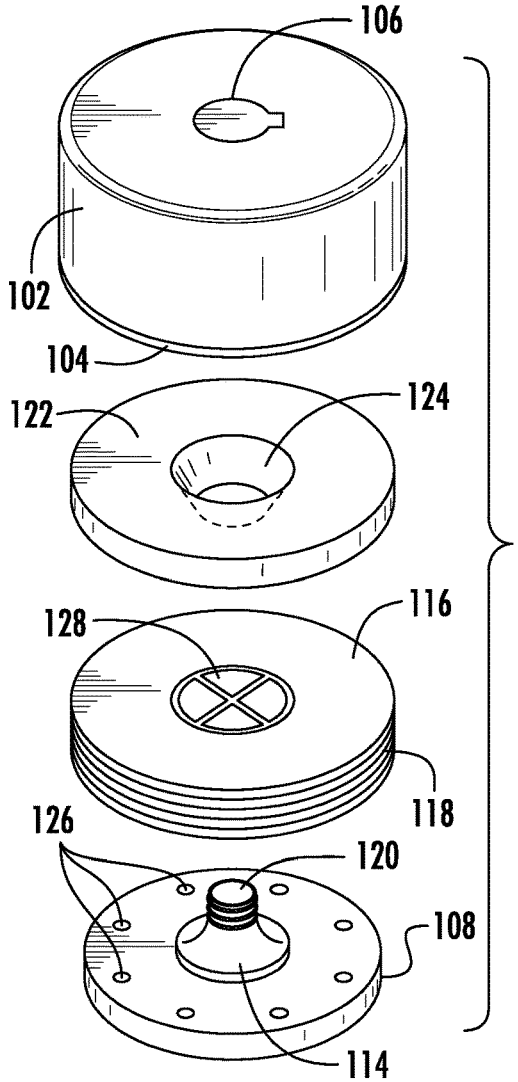
FIG. 5 is an exploded view of the pneumatic vacuum cleaner of FIG. 1.

The Tesla impeller uses low pressure air entering the inlet 128 in the center, and the platters spin the air to increase pressure on the outside of the platters. The air then proceeds to stage two or to a plurality of apertures 126 of the manifold 108. A one stage three platter Tesla impeller is shown in FIGS. 4 and 5. An exploded view of the elements of the cleaner 100 is illustrated in FIG. 5.

The manifold 108 is mounted to the lower surface of the impeller housing 116 and has the plurality of apertures 126 formed in an upper surface for receiving the pressurized air. The plurality of air nozzles 110 are secured proximate a lower surface of the manifold 108 and are configured to direct air downward and away from the manifold 108 to entrain debris into the air and simultaneously use the pressurized air to lift the cleaner 100.

In addition, a concentric passageway 112 is formed adjacent an inside surface of the external body shell 102 and is configured to recirculate the pressurized air from the plurality of air nozzles 110 back to the dustbin 122 and the impeller housing 116 via the concentric passageway 112. Accordingly, the pressurized air is forced out of the plurality of air nozzles 110 from the bottom of the manifold 108 at an increased velocity, and is forced back up along the inside of the external body shell 102 to where it travels over and along the top of the dustbin 122. There is a larger open area above the dustbin 122 that causes the air velocity to be reduced so that the debris is no longer entrained into the airflow. The debris falls into the collector 124 before the air enters the inlet 128 of the impeller housing 116 to recirculate once again.

An electric motor 114 is coupled to a shaft 120 that is coupled to and rotates the impeller 118. The motor 114 includes a controller 115 that is used to control and program the motor 114. For example, the motor 114 may be programmed to rotate at a higher rate to increase the velocity of the pressurized air when the cleaner 100 is used on carpet. The motor 114 can likewise be programmed to rotate at a lower rate when the cleaner 100 is used on a hard flooring surface. In addition, a power source 117, such as rechargeable batteries, is coupled to the motor 114. The rechargeable batteries 117 or other power source may be recharged as those of ordinary skill in the art can appreciate.

Figure 6:
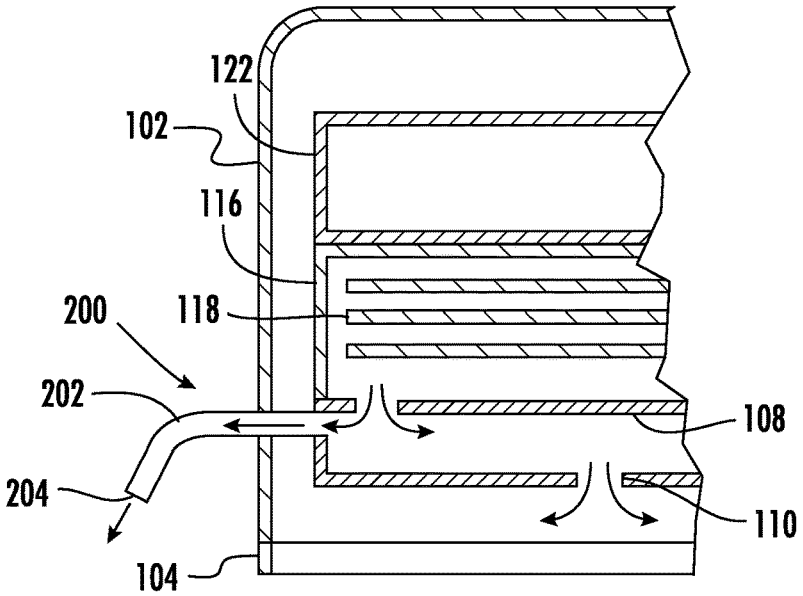
FIG. 6 is a partial cross-sectional view of a propulsion device of the pneumatic vacuum cleaner of FIG. 1.

In a particular aspect, a propulsion device 200 is illustrated in FIG. 6. The propulsion device 200 may include a tube 202 and nozzle 204. The propulsion tube 202 is coupled to the manifold 108 and is configured to receive pressurized air and the direct the pressurized air away from the external body shell 202 to propel the cleaner 100. The propulsion tube 202 may be of a flexible material that moves in random directions as the pressurized air is discharged through the nozzle 204. This in effect will cause the cleaner 100 to be moved around in random directions to clean the flooring.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A pneumatic vacuum cleaner comprising:

an external body shell having an internal chamber defined therein;

a dustbin carried within the internal chamber of the external body shell and having an upper surface and a lower surface;

an impeller housing positioned below the dustbin and having an upper surface and a lower surface, the upper surface having an inlet therein and coupled to the dustbin;

an impeller rotationally mounted within the impeller housing and configured to pressurize air exiting the impeller housing;

a manifold mounted to the lower surface of the impeller housing and having a plurality of apertures formed in an upper surface of the manifold for receiving the pressurized air; and a plurality of air nozzles secured proximate a lower surface of the manifold and configured to direct air downward and away from the manifold to entrain debris into the air and simultaneously use the pressurized air to lift the cleaner;

a flexible propulsion tube and nozzle, the flexible propulsion tube is coupled to the manifold and configured to receive the pressurized air and direct the pressurized air away from the external body shell to propel the cleaner in random directions;

wherein a concentric passageway is formed adjacent an inside surface of the external body shell and configured to recirculate the pressurized air from the plurality of air nozzles back to the dustbin and the inlet of the impeller housing via the concentric passageway.

2. The cleaner of claim 1, wherein the dustbin comprises a removable collector configured to remove debris from the air before it enters the inlet of the impeller housing.

3. The cleaner of claim 2, wherein the external body shell having an access plate positioned to access and remove the removable collector from the dustbin inside the external body shell.

4. The cleaner of claim 1, further comprising a skirt secured to a bottom edge of the external body shell.

5. The cleaner of claim 1, wherein the impeller comprises a Tesla impeller.

6. The cleaner of claim 1, further comprising an electric motor coupled to the impeller.

7. The cleaner of claim 6, further comprising a rechargeable power source to drive the electric motor.

8. The cleaner of claim 1, wherein a bottom surface of the manifold comprises a layer of ultra high density polyurethane.

9. The cleaner of claim 1, wherein the impeller comprises a multi-stage impeller.

10. A pneumatic vacuum cleaner comprising:

an external body shell having an internal chamber defined therein;

an impeller housing within the internal chamber and having an upper surface and a lower surface;

an impeller rotationally mounted within the impeller housing and configured to pressurize air exiting the impeller housing;

a manifold mounted to the lower surface of the impeller housing for receiving the pressurized air;

a plurality of air nozzles secured proximate a lower surface of the manifold and configured to direct air downward and away from the manifold to entrain debris into the air and simultaneously use the pressurized air to lift the cleaner; and a flexible propulsion tube and nozzle, the flexible propulsion tube is coupled to the manifold and configured to receive the pressurized air and direct the pressurized air away from the external body shell to propel the cleaner in random directions;

wherein a passageway is formed adjacent an inside surface of the external body shell and configured to recirculate the pressurized air from the plurality of air nozzles back to an inlet of the impeller housing via the passageway.

11. The cleaner of claim 10, further comprising a dustbin carried by the internal chamber and coupled to an inlet of the impeller housing.

12. The cleaner of claim 11, wherein the external body shell having an access plate positioned to access and remove a collector from the dustbin inside the external body shell.

13. The cleaner of claim 10, further comprising a skirt secured to a bottom edge of the external body shell and configured to hold the pressurized air.

14. The cleaner of claim 10, wherein the impeller comprises a Tesla impeller.

15. The cleaner of claim 10, further comprising an electric motor coupled to the impeller.

16. The cleaner of claim 15, further comprising a rechargeable power source to drive the electric motor.

17. The cleaner of claim 10, wherein a bottom surface of the manifold comprises ultra high density polyurethane.

18. A pneumatic vacuum cleaner comprising:

an external body shell having an internal chamber defined therein;

an impeller housing within the internal chamber and having an upper surface and a lower surface;

an impeller mounted within the impeller housing and configured to pressurize air exiting the impeller housing;

a manifold mounted to the lower surface of the impeller housing for receiving the pressurized air;

a plurality of air nozzles secured proximate a lower surface of the manifold and configured to direct air downward and away from the manifold to entrain debris into the air and simultaneously using the pressurized air to lift the cleaner;

a flexible propulsion tube and nozzle, the flexible propulsion tube is coupled to the manifold and configured to receive the pressurized air and direct the pressurized air away from the external body shell to propel the cleaner in random directions; and a passageway configured to return the pressurized air from the plurality of air nozzles back to an inlet of the impeller housing.

* * * * *